United States Patent [19]

Fender

[11] Patent Number: 4,581,974

[45] Date of Patent: Apr. 15, 1986

[54] HUMBUCKING PICK-UP ASSEMBLY INCLUDING AN UNMAGNETIZED, DISASSOCIATED COIL

[76] Inventor: C. Leo Fender, 1510 Dana Pl., Fullerton, Calif. 92635

[21] Appl. No.: 598,219

[22] Filed: Apr. 9, 1984

[51] Int. Cl.[4] ..... G10H 3/18

[52] U.S. Cl. ..... 84/1.15; 84/1.16

[58] Field of Search ..... 84/1.15, 1.16

[56] References Cited

U.S. PATENT DOCUMENTS 4,151,776 5/1979 Stich ..... 84/1.16

4,480,520 11/1984 Gold ..... 84/1.16

*Primary Examiner*—Stanley J. Witkowski

*Attorney, Agent, or Firm*—Spensley, Horn, Jubas & Lubitz

[57] ABSTRACT

A pick-up assembly for stringed musical instruments including a pair of pick-up assemblies, only one of which is magnetized. The first and second pick-up assemblies are physically disassociated so that the reactance of the unmagnetized pick-up assembly does not interfere with the magnetized pick-up assembly. The unmagnetized pick-up assembly is lowered further into the body of the instrument than the magnetized pick-up assembly for the same purpose. The outputs of the two pick-up assemblies are summed at the negative input of an operational amplifier which negative input is a virtual ground so that neither coil acts as a load for the other coil.

8 Claims, 3 Drawing Figures

HUMBUCKING PICK-UP ASSEMBLY INCLUDING AN UNMAGNETIZED, DISASSOCIATED COIL

BACKGROUND OF THE INVENTION

1. Field of the Invention

The present invention relates to a humbucking pick-up assembly for stringed musical instruments and, more particularly, to a pick-up assembly for stringed musical instruments including a magnetized, signal coil and an unmagnetized, disassociated, humbucking coil.

2. Description of the Prior Art

The present invention relates broadly to electrical musical instruments of the stringed type. It is particularly applicable to an electrical guitar or similar musical instrument having a plurality of stretched strings extending across a body and a neck, between the head of the instrument and a bridge assembly connected to the body, in which the strings are caused to vibrate by plucking or picking same.

In order to derive an output from such an electrical guitar or other similar electrical musical instrument, the instrument is conventionally provided with an electromagnetic pick-up comprising a number of magnetic elements (pole pieces) having wound therearound a conductive coil. Typically, one such magnetic element is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate, this causes a disturbance in the magnetic field of the associated pole piece. This has the effect of generating a voltage in the conductive coil, which voltage may be suitably amplified and transmitted to a loudspeaker system.

With such an electromagnetic pick-up construction, a number of problems exist. Electric guitars and other similar electrical musical instruments are used in areas having strong magnetic fields from lighting fixtures, motors, transformers, and the like, and these magnetic fields are sensed by the pick-up as an extraneous noise source. In the United States, such source typically has a frequency of 60 Hz, the usual power line frequency. These magnetic fields induce voltages in the coil which are also amplified and transmitted to the loudspeaker system, manifesting themselves in an objectionable hum.

In order to overcome this problem, it is known to provide a pick-up for an electrical musical instrument including a pair of identical pick-up assemblies, each having a plurality of magnetic pole pieces and a coil, the pick-up assemblies being positionable in parallel, spaced, closely adjacent relationship. All of the pole pieces of one of the pick-up assemblies have their north poles adjacent to the strings and their south poles relatively remote from the strings whereas all of the pole pieces of the other pick-up assembly have their south poles adjacent to the strings and their north poles relatively remote from the strings. The coils of the two pick-up assemblies are wound in opposite directions and the two coils are connected either in series or in parallel. Because the direction of current flow in each coil is governed by the magnetic polarity, the direction of current flow in one coil is opposite to that of the other coil for each string. However, since the directions of the windings of the two coils are opposite, the signal induced in each coil as a result of string vibrations is additive and the output signal is the sum of the signals induced in each coil.

On the other hand, signals picked up by the coils from power line sources produce currents in the coils which are independent of the magnetic polarity and, accordingly, such power line sources produce voltages that are in phase. However, since the coils are wound in opposite directions, these in phase signals cancel and the output signal is the difference between the power line signals induced in each coil. This means that any noise from power line sources, which is otherwise manifested as an objectionable hum, is effectively reduced or cancelled. It is for this reason that such an arrangement is typically characterized as a humbucking arrangement.

While the use of pairs of pick-up assemblies in a humbucking arrangement is effective in eliminating extraneous noise, a new problem is created, that being that the sound produced by a humbucking pick-up assembly is not as sharp and as clear as that obtainable from a single pick-up assembly. The reason for this is felt to be that each pick-up assembly of the humbucking pair interferes with the operation of the other pickp-up assembly of the pair. This is because the coil of each pick-up assembly acts as a load for the coil of the other pick-up assembly and the magnetic field of one pick-up assembly interferes with the magnetic field of the other. Thus, it would be desirable to provide a humbucking pick-up assembly having the tone producing qualities of a single coil but this has been unobtainable heretofore.

SUMMARY OF THE INVENTION

According to the present invention, this problem is solved by providing an electrical musical instrument of the stringed type with a humbucking pick-up having the tonal qualities of a single coil pick-up. This is achieved by the combination of a number of effects. First of all, the present pick-up includes a pair of pick-up assemblies, only one of which is magnetized. The first and second pick-up assemblies are physically disassociated so that the reactance of the unmagnetized pick-up assembly does not interfere with the magnetized pick-up assembly. The unmagnetized pick-up assembly is also lowered further into the body of the instrument than the magnetized pick-up assembly to further disassociate the two pick-up assemblies. Finally, rather than simply being connected in series or in parallel, the outputs of the two pick-up assemblies are summed at the negative input of an operational amplifier, which negative input is a virtual ground, so that neither coil acts as a load for the other coil.

Briefly, in a pick-up for an electrical musical instrument of the type including a body, a neck having a head, a bridge assembly connected to the body and a plurality of strings positioned between the head and the bridge assembly, the present invention comprises a first pick-up assembly positioned between the neck and the bridge assembly, the first pick-up assembly including at least one magnetized pole piece and a coil wound therearound, a second pick-up assembly positioned in spaced relationship to the first pick-up assembly, between the neck and the bridge assembly, the second pick-up assembly including at least one unmagnetized pole piece and a coil wound therearound, the pole piece of the second pick-up assembly being spaced from the strings by an amount greater than the spacing between the pole piece of the first pick-up assembly and the strings, and first and second resistors for connecting the coils of the first and second pick-up assemblies, respectively, to the negative input of an operational amplifier.

OBJECTS, FEATURES AND ADVANTAGES

It is therefore the object of the present invention to solve the problems encountered heretofore in providing a humbucking pick-up for an electrical musical instrument of the stringed type. It is a feature of the present invention to solve these problems by providing a humbucking pick-up for an electrical musical instrument of the stringed type having a sound which is characteristic of the sound from a single coil pick-up. An advantage to be derived is a humbucking pick-up having a far more desirable sound. A further advantage is a humbucking pick-up including a pair of pick-up assemblies wherein the interference of one pick-up assembly to the other is minimal.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
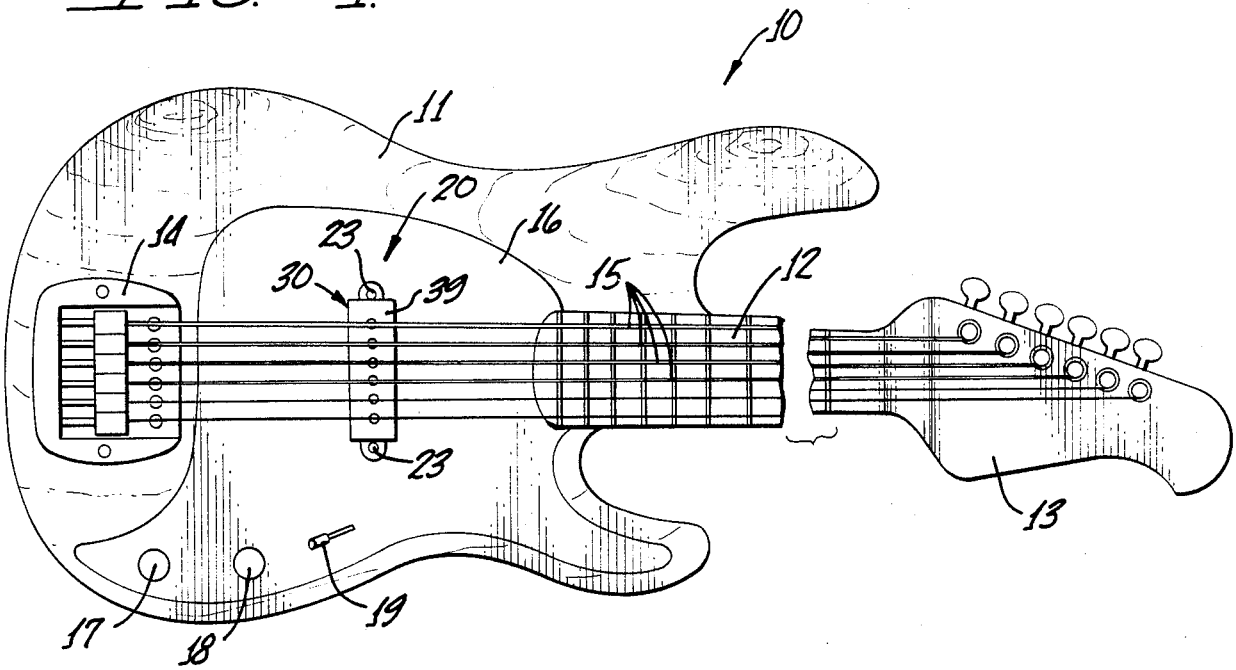
FIG. 1 is a top plan view of an electrical musical instrument of the stringed type incorporating a pick-up constructed in accordance with the teachings of the present invention.

Referring now to the drawings and, more particularly, to FIG. 1 thereof, the present invention is illustrated as being incorporated in an electrical guitar, generally designated 10, including a body 11, a fretted neck 12, and a head 13 connected to one end of neck 12, the other end of neck 12 being connected to body 11. Tensioned between head 13 of guitar 10 and a body-connected bridge assembly 14 are a plurality of strings 15 which generally lie in a single plane parallel to the face of body 11. Strings 15 are constructed of a magnetizable substance, such as steel, and are graduated in diameter in a conventional manner.

Positioned on the face of body 11 is a pick guard 16 which is typically made from plastic or other scratch resistant material. Also mounted on the face of body 11 is a volume control 17, a tone control 18, and a two-position switch 19.

In order to derive an output from guitar 10, it is provided with an electromagnetic pick-up, generally designated 20, which forms the subject matter of the present invention. Vibrations of strings 15, as a result of plucking or picking the same, produce an electrical signal in pick-up 20, which signal may be suitably amplified and transmitted to a loudspeaker system.

Figure 2:
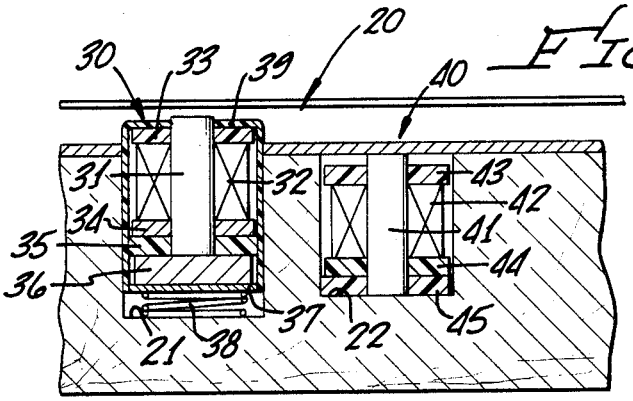
FIG. 2 is an enlarged sectional view taken along the cross section of the pickup in FIG. 1.
Figure 3:
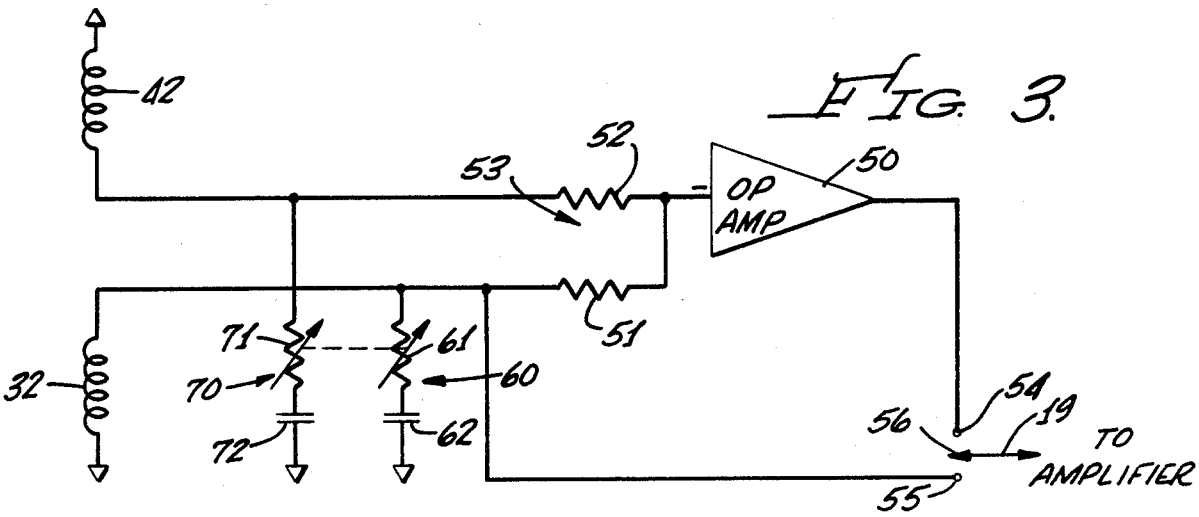
FIG. 3 is an electrical diagram of the pick-up of the instrument of FIG. 1.

Referring now to FIGS. 1–3, pick-up 20 includes first and second pick-up assemblies 30 and 40 which are positioned in spaced relationship between neck 12 and bridge assembly 14. It is unimportant as to whether pick-up assembly 30 or pick-up assembly 40 is positioned closer to bridge assembly 14. Pick-up assemblies 30 and 40 have some features in common, but are generally quite different. Each includes a plurality of identical metallic, unmagnetized elements (pole pieces) 31 and 41, respectively. The number of pole pieces in each pick-up assembly is preferably identical and preferably the same as the number of strings 15. However, such is not required and each pick-up assembly 30 and 40 can have any number of pole pieces from one or more.

Pick-up assemblies 30 and 40 are generally constructed and mounted in body 11 in a conventional manner. That is, pick-up assemblies 30 and 40 include upper and lower support plates 33 and 34 and 43 and 44, respectively, through which pole pieces 31 and 41, respectively, extend and bottom support plates 35 and 45, respectively, which extend below lower support plates 34 and 44, respectively. Coils 32 and 42, formed from a large number of turns of fine conductive wire, are wound around pole pieces 31 and 41, respectively. The wire in coils 32 and 42 is insulated, such as with varnish or lacquer, and the entire assemblies comprising the pole pieces, the supporting plates and the coils are preferably dipped in a suitable varnish or lacquer. Coil 32 extends between support plates 33 and 34 and coil 42 extends between support plates 43 and 44.

As stated previously, the individual pole pieces 31 and 41 are not magnetized, but are made from a magnetizable substance. Only pick-up assembly 30 is magnetized and the magnetic field is preferably produced by positioning a bar magnet 36 in contact with the bases of pole pieces 31. Preferably, a magnetic keeper 37 also extends along the bottom surface of magnet 36. It should be particularly noted that pick-up assembly 40 has neither a bar magnet nor a keeper.

Pick-up assemblies 30 and 40 are positioned within channels 21 and 22, respectively, in body 11. A spring 38 extends between keeper 37 and the bottom of channel 21 to urge pick-up assembly 30 upwardly. A cap 39 surrounds and contains the structure of pick-up assembly 30. A plurality of screws 23 extend through cap 39 and hold pick-up assembly 30 within channel 21 and body 11. Cap 39 extends through pick guard 16. Accordingly, the manipulation of screws 23 permits the height of pick-up assembly 30 to be adjusted. Pick-up 40, on the other hand, does not extend through pick guard 16 and is captured within channel 22 in body 11 by pick guard 16.

As known in the art, movement of strings 15, as in the strumming or playing of guitar 10, results in a voltage being induced in coil 32. As will be described more fully in connection with FIG. 3, this voltage is transferred to the input circuit of an operational amplifier 50 before being conducted to a suitable loudspeaker system. On the other hand, since pole piece 41 is not magnetized, movement of strings 15 does not induce a voltage therein.

On the other hand, signals picked up by coils 32 and 42 from power line sources are totally independent of magnetic fields so that both coils 32 and 42 produce currents which are proportional to received noise. Coils 32 and 42 may be wound in opposite directions or otherwise connected in an out of phase relationship so that these signals cancel. Thus, in a conventional manner, noise from power line sources, which is otherwise manifested as an objectionable hum, may be effectively reduced or cancelled.

Turning now to FIG. 3, first ends of coils 32 and 42 are connected to circuit ground. The opposite ends of coils 32 and 42 are connected via resistors 51 and 52, respectively, which are parts of a summing circuit 53, to the negative input of operational amplifier 50, the output of which is connected to a first terminal 54 of switch 19, switch 19 having another terminal 55 which is connected directly to coil 32. Switch 19 has an arm 56 which is connectable either to terminal 54 or 55.

Operational amplifier 50 is a conventional circuit well known to those skilled in the art. It is significant to note that summing network 53 applies the signals from coils 32 and 42 to the negative input terminal of operational amplifier 50, which is a virtual ground. By making the junction between resistors 51 and 52 a virtual ground, neither coil 32 nor coil 42 has any significant loading effect on the other. Additional circuitry (not shown) will be associated with operational amplifer 50, such circuitry being well known to those skilled in the art and not relevant to an understanding of the present invention.

Coils 32 and 42 are each provided with separate tone control circuits 60 and 70, respectively. While such tone control circuits might not be so simple, for explanation purposes, tone control circuit 60 is shown as including a variable resistor 61 and a capacitor 62 connected in series between coil 32 and circuit ground and tone control circuit 70 is shown as including a variable resistor 71 and a capacitor 72 connected in series between coil 42 and circuit ground. According to the preferred embodiment of the invention, variable resistors 61 and 71 are mechanically interconnected and become the tone control circuit 18 of instrument 10 so that the magnetized coil 32 and the unmagnetized coil 42 may be balanced simultaneously.

Coils 32 and 42 are either wound in opposite directions or, if the coils are wound in the same direction, the opposite ends of the coils are connected to summing circuit 53. Because coil 42 is unmagnetized, it is not responsive to string vibrations. On the other hand, coil 42 does pick up noise signals because such signals are not dependent on a magnetic polarity. Because of the manner of connecting coils 32 and 42 to summing circuit 53, as just described, coil 42 is capable of operating in a humbucking arrangement with coil 32.

In operation, it is seen that by unmagetizing pick-up 40, laterally displacing and physically lowering pick-up 40 relative to pick-up 30, and by summing coils 32 and 42 at the negative input of operational amplifier 50, the effect of pick-up 40 on pick-up 30 is minimized and the sound produced by pick-up 20 is essentially that which would be achieved by coil 32 alone. The physical disassociation of pick-up assemblies 30 and 40 insures that pick-up assembly 40 does not interfere with the magnetic reactance of pick-up 30. The electrical connection of coils 32 and 42 also minimizes any loading effect of coil 42 on coil 32.

It is highly desirable that pick-up 20 function if the preamplifier circuit including operational amplifier 50 becomes inoperative, either because of problems associated therewith or because the batteries that run same in guitar 10 go dead. Accordingly, the output of operational amplifier 50 is connected to terminal 54 of switch 19 and coil 32 is connected to terminal 55 of switch 19. When connected to terminal 54, operation is as previously described. When connected to terminal 55, the signal from coil 32 is conducted directly to the amplification system, thereby bypassing summing resistor 51 and maximizing the signal strength conducted to the amplifier. It is obvious that in this latter case, there will be no humbucking.

While the invention has been described with respect to the preferrd physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a pick-up for an electrical musical instrument of the type including a body, a neck having a head, a bridge assembly connected to said body and a plurality of strings positioned between said head and said bridge assembly, the improvement comprising:

a first pick-up assembly positioned between said neck and said bridge assembly, said first pick-up assembly including at least one magnetized pole piece and a coil wound therearound;

a second pick-up assembly positioned in spaced relationship to said first pick-up assembly, between said neck and said bridge assembly, said second pick-up assembly including at least one unmagnetized pole piece and a coil wound therearound wherein said pole piece of said second pick-up assembly is spaced from said strings by an amount greater than the spacing between said pole piece of said first pick-up assembly and said strings; and summing means for summing the signals from said first and second pick-up assemblies for conducting said signals to amplification means, said signals being combined so as to achieve humbucking.

2. In a pick-up for an electrical musical instrument according to claim 1, said musical instrument also including a pick guard on the face of said body, facing said strings, the improvement wherein said first pick-up assembly extends through said pick guard into close proximity to said strings and wherein said second pick-up assembly is buried within said body, below said pick guard.

3. In a pick-up for and electrical musical instrument according to claim 2, the improvement wherein said second pick-up assembly is spaced from said first pick-up assembly by an amount sufficient so that said second pick-up assembly does not interfere with the magnetic reactance of said first pick-up assembly.

4. In a pick-up for an electrical musical instrument according to claim 1, the improvement wherein said summing means comprises:

an operational amplifier having a negative input terminal which is a virtual ground; and means for conducting the signals from said first and second pick-up assemblies to said negative input of said operational amplifier.

5. In a pick-up for an electrical musical instrument according to claim 4, the improvement wherein said conducting means comprises:

first and second resistors connected between said coils of said first and second pick-up assemblies, respectively, and said negative input of said operational amplifier.

6. In a pick-up for an electrical musical instrument according to claim 1, the improvement wherein said summing means comprises:

an operational amplifier having a negative input terminal which is a virtual ground; and means for conducting the signals from said first and second pick-up assemblies to said negative input of said operational amplifier.

7. In a pick-up for an electrical musical instrument according to claim 6, the improvement wherein said conducting means comprises:

first and second resistors connected between said coils of said first and second pick-up assemblies, respectively, and said negative input of said operational amplifier.

8. In a pick-up for an electrical musical instrument according to claim 1, the improvement further comprising:

a first tone control circuit connected to said coil of said first pick-up assembly, said first tone control circuit having a first variable element; and a second tone control circuit connected to said coil of said second pick-up assembly, said second tone control having a second variable element;

said first and second variable elements being mechanically interconnected for simultaneous adjustment.

* * * * *